US005462029A

United States Patent [19]

Nicol

[11] Patent Number: 5,462,029

[45] Date of Patent: Oct. 31, 1995

[54] FUEL PUMPING APPARATUS

[75] Inventor: Stuart W. Nicol, London, England

[73] Assignee: Lucas Industries public limited company, West Midlands, United Kingdom

[21] Appl. No.: 244,332

[22] PCT Filed: Dec. 16, 1992

[86] PCT No.: PCT/GB92/02331

§ 371 Date: May 24, 1994

§ 102(e) Date: May 24, 1994

[87] PCT Pub. No.: WO93/13308

PCT Pub. Date: Jul. 8, 1993

[30] Foreign Application Priority Data

Dec. 20, 1991 [GB] United Kingdom ..... 9127130
Mar. 20, 1992 [GB] United Kingdom ..... 9206129

[51] Int. Cl.[6] ..... F02M 41/14; F02M 59/36

[52] U.S. Cl. ..... 123/450; 123/506; 417/462

[58] Field of Search ..... 123/450, 506; 417/462

[56] References Cited

U.S. PATENT DOCUMENTS

| | | | |
|---|---|---|---|
| 4,180,037 | 12/1979 | Hobo et al. . | |
| 4,200,072 | 4/1980 | Bailey | 123/450 |
| 4,401,082 | 8/1983 | Leblanc | 123/450 |
| 4,473,048 | 9/1984 | Lebanc et al. | 123/450 |
| 4,889,096 | 12/1989 | Brunel | 123/450 |
| 4,896,633 | 1/1990 | Junghans et al. | 123/450 |
| 4,896,645 | 1/1990 | Potter | 123/450 |
| 5,215,449 | 6/1993 | Ilija | 417/462 |
| 5,244,354 | 9/1993 | Nicol | 417/462 |
| 5,318,001 | 6/1994 | Djordjevic | 123/450 |

*Primary Examiner*—Thomas N. Moulis
*Attorney, Agent, or Firm*—Trexler, Bushnell, Giangiorgi & Blackstone, Ltd.

[57] ABSTRACT

A fuel pumping apparatus for supplying fuel to an internal combustion engine has a plurality of pumping plungers (19) which are housed in respective bores (17). The plungers are movable inwardly in the bores but during such movement one of the plungers moves to an outer position in which a fuel supply passage (21) which communicates with a fuel supply passage (21) which communicates with a fuel outlet (22) is uncovered to the pump working chamber (20) defined at the inner ends of the bores. Each bore has a supply passage associated therewith. A cam ring (25) is provided to impart inward movement of the plungers and the cam ring is provided with cam lobes (26) on its internal peripheral surface however one of the cam lobes is replaced by a recess which allows the plungers to move outwardly in turn so that fuel is distributed to the outlets which in use are connected to the injection nozzles of an engine.

10 Claims, 6 Drawing Sheets

FUEL PUMPING APPARATUS

This invention relates to a fuel pumping apparatus for supplying fuel to a multi cylinder internal combustion engine and of the kind comprising a plurality of cam actuated pumping plungers housed within respective bores defined in a body, the bores at their inner ends communicating with each other and forming a pump working chamber, a cam member having cam lobes formed thereon for actuating the pumping plungers to displace fuel from the pump working chamber, a pump drive shaft for imparting relative rotation between the body and the cam member, a plurality of outlet ports which are connected to the injection nozzles of the associated engine respectively, valve means responsive to the rotation of the pump drive shaft through which fuel displaced from the pump working chamber is supplied to the outlets in turn during successive delivery periods and means for supplying fuel to the pump working chamber between said delivery periods.

In a known form of the apparatus as shown for example in EP-A-0364076, the aforesaid body comprises a rotary cylindrical member which is coupled to the drive shaft and which is located in a bore formed in a fixed housing of the apparatus. The rotary member has a so called delivery passage which communicates with the pump working chamber and opens onto the periphery of the rotary member. The delivery passage is positioned to register in turn with a plurality of outlet ports which open into the bore and which communicate with the outlets respectively so that each outlet receives fuel in turn. The machining of the bore in the housing and the surface of the distributor member requires a great deal of care. If the clearance between the two components is too great, the leakage of high pressure fuel will be unacceptable. On the other hand if the clearance is too small there is a risk of seizure of the two components when the apparatus is in use.

The object of the present invention is to provide an apparatus of the kind specified in an improved form.

According to the invention in an apparatus of the kind specified said body is fixed and the cam member is coupled to the pump drive shaft so as no be rotated thereby, said cutlets being formed in said body and the valve means for feeding fuel to the outlets in turn being housed in said body and interposed between the pump working chamber and the outlets respectively.

According to a further feature of the invention said valve means is defined by the pumping plungers and the cam member is arranged so that prior to displacement of fuel from the pump working chamber one of the plungers is moved to a position to allow fuel to flow from the working chamber to one of the outlets, the plungers being moved to said position in turn so that the outlets receive fuel in turn.

Figure 1:
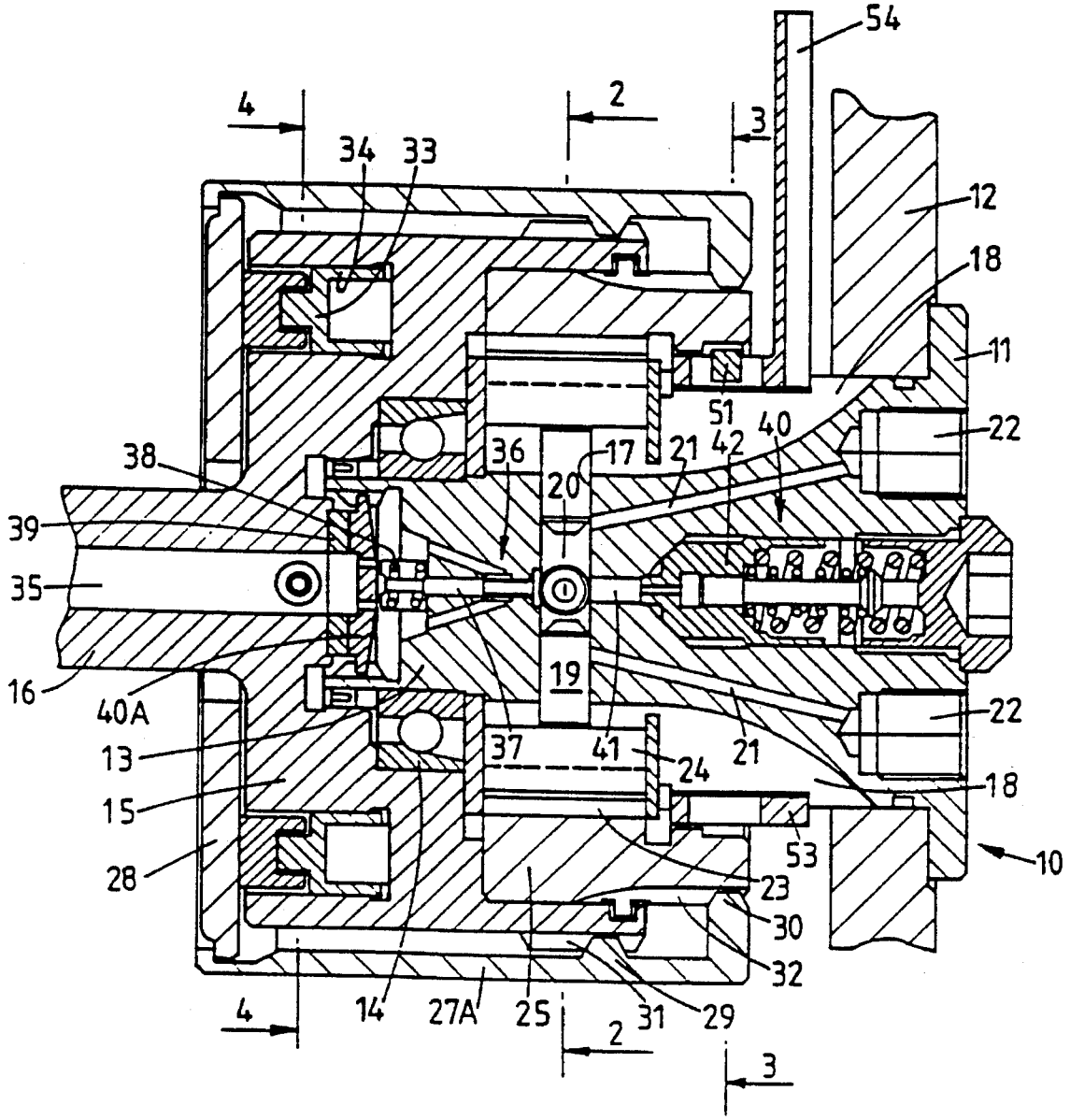
Figure 2:
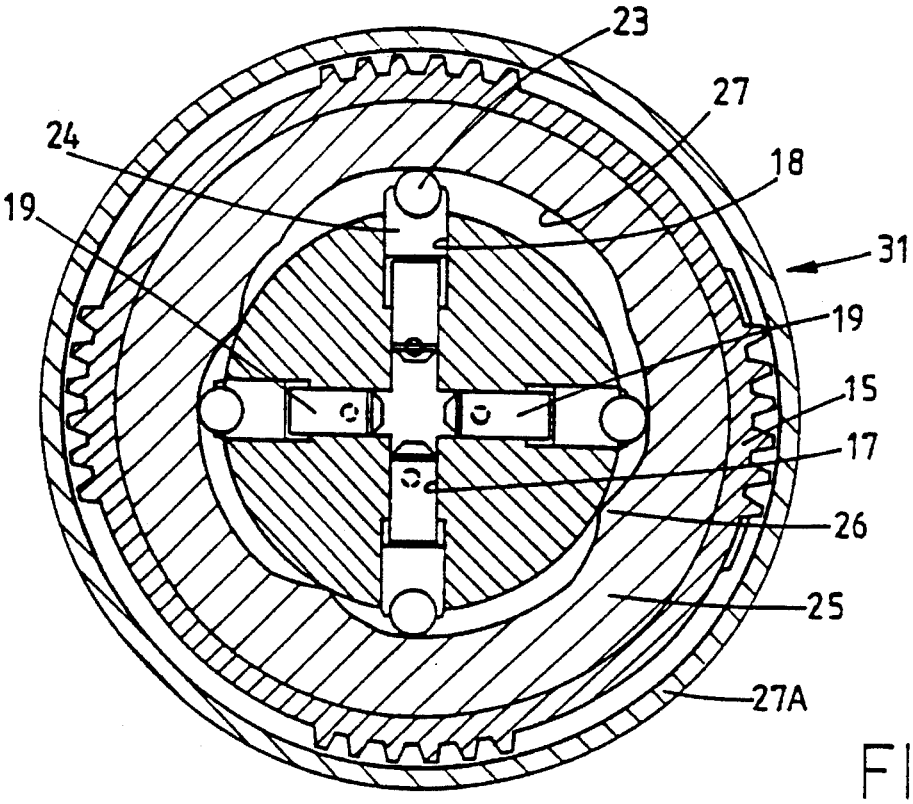
Figure 3:
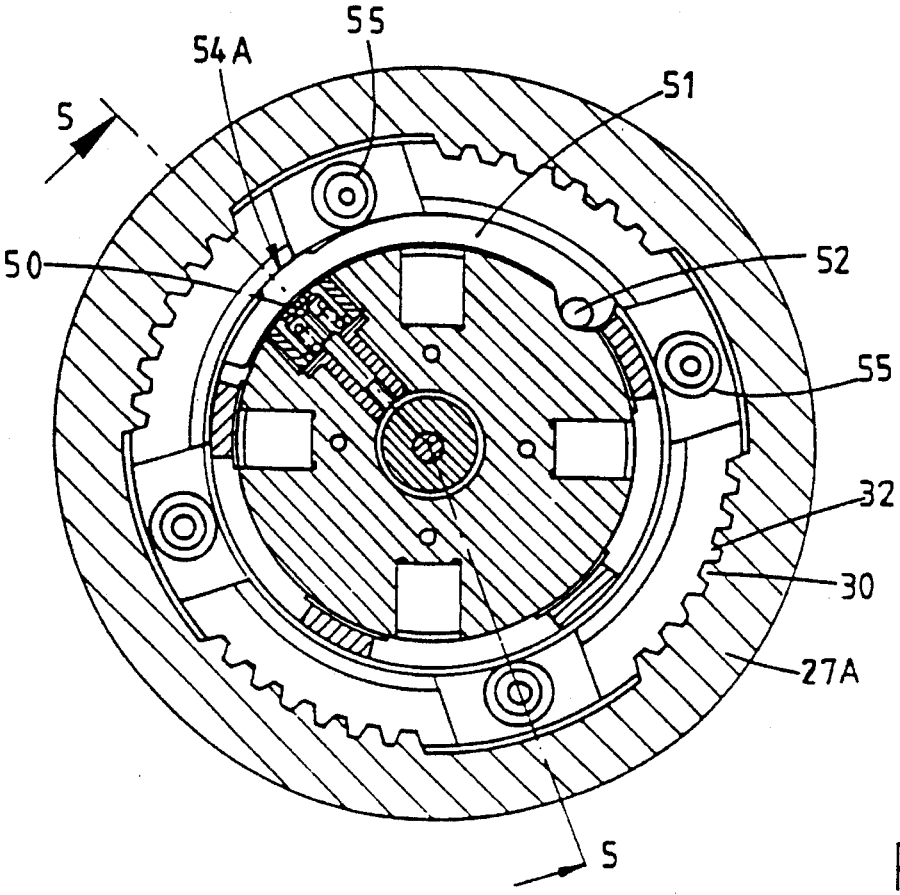
Figure 4:
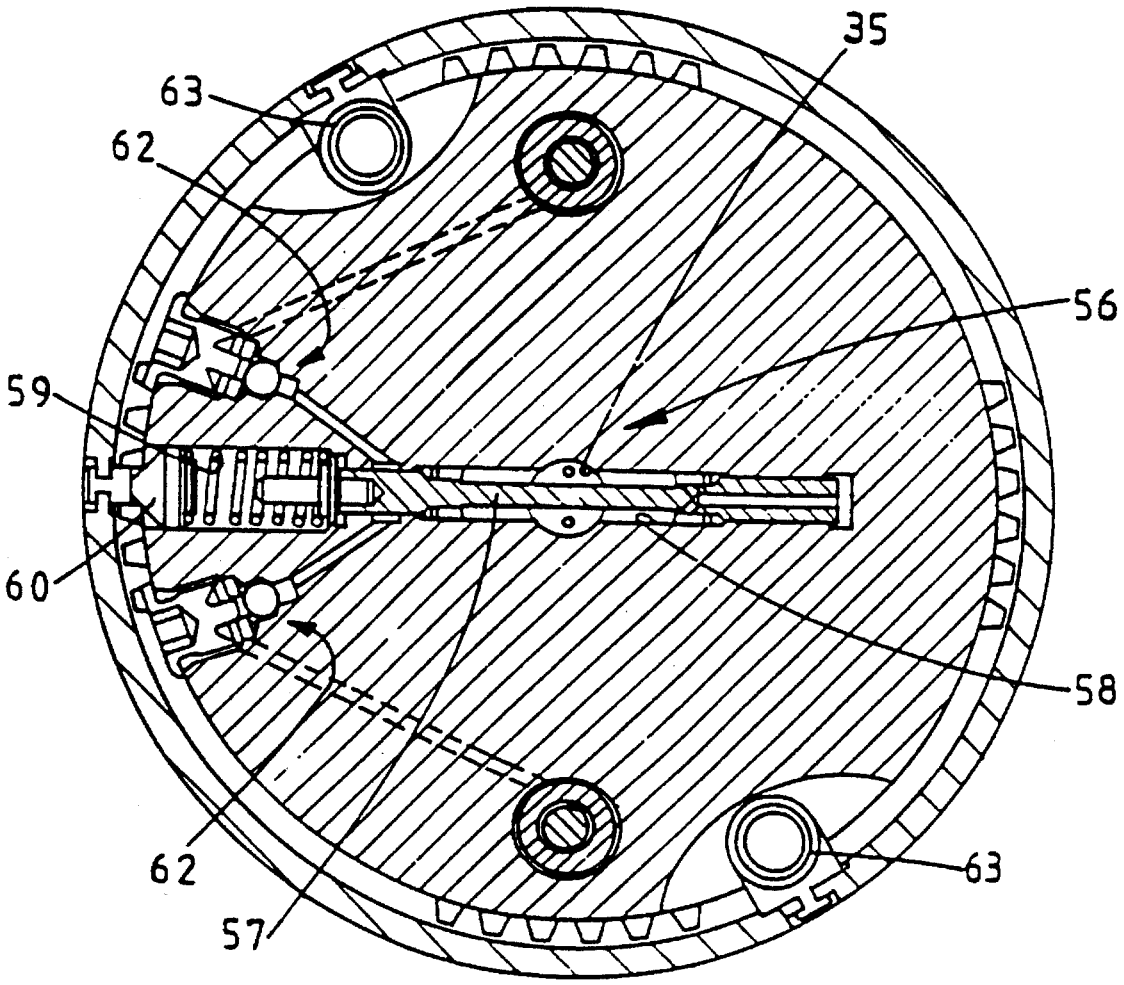
Figure 5:
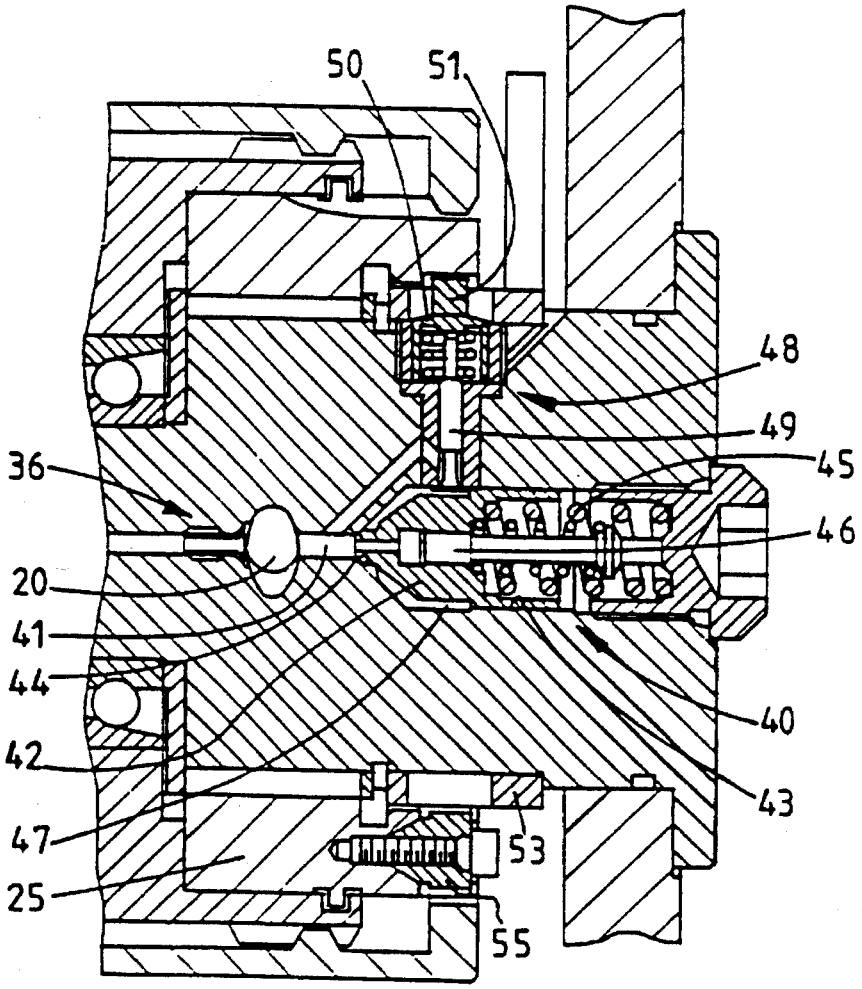
Figure 6:
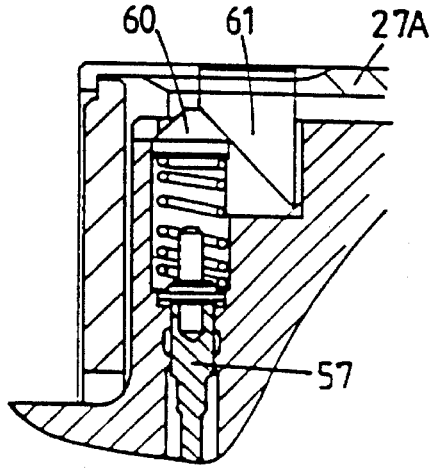

An example of a fuel pumping apparatus in accordance with the invention will now be described with reference to the accompanying drawings in which:

FIG. 1 is a sectional side elevation of part of the apparatus,

FIGS. 2, 3 and 4 are cross-sections on the lines 2—2, 3—3, and 4—4 of FIG. 1, FIG. 5 is a sectional side elevation on the line 5—5 of FIG. 3, FIG. 6 is a view of part of the apparatus seen in FIG. 4 taken at right angles thereto, and FIG. 7–10 show modifications to the the apparatus of FIGS. 1–6.

Referring to the drawings the apparatus comprises a stepped cylindrical main body 10 having a flange 11 which locates against a portion 12 of the housing of the apparatus. The main body 10 defines a spigot portion 13 at its end remote from the flange and the spigot portion is surrounded by a bearing 14 which locates an enlarged portion 15 of a drive shaft 16 about the main body. The drive shaft is supported by further bearings not shown within the housing and in use is driven in timed relationship with the associated engine.

Formed in the body 10 is in the particular example, a pair of transversely extending bores 17 the axes of which are disposed at right angles to each other and normal to the axis of rotation of the drive shaft.

The outer ends of the bores open into slots 18 respectively which are formed in the main body. Each bore 17 accommodates a pair of pumping plungers 19. The inner ends of the plungers are of frusto-conical form and the inner ends of the plungers together with the bores form a pump working chamber 20.

Communicating with the bores at positions on opposite sides of the point of intersection of the bores, are outlet passages 21 respectively and these communicate with outlets 22 in the main body and which in use, are connected to the injection nozzles of the associated engine.

Located in the slots 18 are cam followers each of which comprises a roller 23 and a shoe 24. As more clearly seen in FIG. 2, the shoes engage the outer ends of the plungers and the rollers engage the internal peripheral surface of an annular cam ring 25. On the internal surface of the cam ring there is formed a plurality of cam lobes 26 there being in the particular example one less cam lobe than the number of plungers. The angular spacing of the cam lobes is equal and is as if there were four cam lobes. In place of the missing cam lobe there is formed a recess 27 and the depth of the recess is such that when a roller is engaged therewith, the associated plunger moves outwardly to a position to expose the entrance into the bore 17 of the associated outlet passage 21.

The cam ring 25 is housed within the enlarged portion 15 of the drive shaft and is angularly movable relative thereto. The cam ring is coupled to the drive shaft by means of an annular coupling member 27A which is located about the drive shaft and is provided with an end plate 28 through which the portion 16 of the drive shaft extends. The coupling member defines two series of gear teeth 29, 30 on its internal peripheral surface. The first series of teeth 29 mesh with a series of teeth 31 which are formed on the external surface of the enlarged portion 15 of the drive shaft and the second series of teeth 30 on the coupling member engage with a series of teeth 32 which are formed on the external surface of the cam ring 25. One of the interengaging sets of teeth is helically arranged so that when the annular coupling member 27A is moved axially, relative angular movement will occur between the enlarged portion of the drive shaft and the cam ring 25. The movement of the coupling member is effected by means of pistons 33 which are located within cylinders 34 respectively formed in the enlarged portion of the drive shaft. The pistons carry bearing members which engage with the end plate 28 and a valve arrangement to be described, controls the admission of fluid under pressure into the cylinders 34.

Fuel is supplied to the working chamber 20 from a low pressure fuel supply pump (not shown) the rotary part of which is connected to the drive shaft 16. The drive shaft 16 defines a passage 35 which communicates with the outlet of the low pressure fuel supply pump and which by way of a popper valve 36 communicates with the pump working chamber 20. The valve member 37 of the popper valve is biased to the closed position by means of a spring 38 and the valve is lifted from its seating by the action of a face cam and follower, the face cam being indicated at 39 and being secured to the drive shaft and the follower being indicated at 40 and being nonrotatably mounted but axially movable in spigot portion 13 of the main body 10.

In order to control the amount of fuel which is supplied by the apparatus to the associated engine there is provided a spill valve 40 which will be described in greater detail, and this controls the flow of fuel through a spill passage 41 which communicates with the pump working chamber.

In operation, and with the parts of the pump occupying the positions shown in the drawing, the filling of the working chamber has been completed and all the plungers 19 have been moved outwardly their maximum extent. As the drive shaft and cam ring 25 rotate (in the anticlockwise direction as seen in FIG. 2) three of the rollers engage the leading flanks of the cam lobes 26 and the associated plungers 19 move inwardly to displace fuel from the working chamber 20. The other plunger remains at its outermost position so that the associated passage 21 is uncovered to the working chamber and as the rollers climb the leading flanks of the cam lobes the fuel expelled from the working chamber will be delivered to one of the outlets 22. Before the rollers reach the crests of the cam lobes the spill valve 40 is operated so that the remaining quantity of fuel which is displaced from the working chamber flows along the spill passage 41. The pressure of fuel in the working chamber is therefore reduced and the appropriate one of the delivery valves (not shown) which are mounted in the outlets 22 respectively, will close to relieve the pressure in the pipeline interconnecting the outlet with the respective injection nozzle. Relief of the pressure in the pipeline takes place with the fuel being returned to the working chamber. During continued rotation of the drive shaft the popper valve 36 is lifted to allow fuel to flow into the working chamber 20 from the passage 35 moreover, during this movement the plunger which was previously in the recess 27 is moved inwardly and the remaining plungers move outwardly as permitted by the trailing flanks of the cam lobes. Moreover, the next plunger moves outwardly a further amount as it moves into the recess 27. The cycle of operation is repeated and fuel is supplied to the outlets in turn.

The spill valve 40 comprises a valve member 42 movable in a cylinder 43 into the end of which the spill passage 41 opens. Surrounding the entrance of the spill passage 41 into the cylinder 43 is a seating 44 and the valve member 42 has a portion of smaller diameter which is shaped for cooperation with the seating. The valve member is biased into engagement with the seating by a coiled compression spring 45 and a pressure balancing piston 46 is located within a bore which is formed in the valve member 42 and which communicates with the passage 41. The valve member and the cylinder define an annular space 47 to which fuel under pressure from the spill passage 41 can be admitted by the action of a control valve 48. This valve comprises a popper valve member 49 which is spring loaded to the closed position. The valve includes an actuating cup 50 which is engagable by a pivotally mounted curved beam 51. The beam 51 as shown in FIG. 3, is provided with a pivot 52 and is carried on an angularly adjustable ring member 53 associated with which is a control lever 54. The outer surface of the beam is provided with a projection 54A which is engagable by cam elements 55 which are secured to the cam ring 25 as seen in FIG. 5. Conveniently the cam elements are of cylindrical form but their external surfaces are eccentric relative to the aperture therethrough so that the cam elements can be angularly adjusted by loosening the securing bolts which pass through the apertures. When during inward movement of the plungers, the control valve 48 is actuated fuel under pressure is supplied to the annular space 47 and acts upon the valve member to lift it from its seating. Once this takes place the remaining quantity of fuel which is displaced from the pump working chamber flows into the cylinder 43 to displace the valve member against the action of its spring loading. The fuel which is retained within the cylinder is returned at the commencement of the following filling stroke. By moving the lever 54 and therefore the arm 51 angularly about the axis of rotation of the drive shaft, the instant during the inward movement of the plungers at which the spill valve is operated, can be controlled and thereby the amount of fuel which is supplied to the associated engine can be controlled. The facility to adjust the cam elements 55 means that the pump can be adjusted to ensure that for a given angular setting of the lever 54, each outlet will receive the same amount of fuel.

As previously stated axial movement of the annular coupling member 27A induces relative angular movement of the cam ring 25 and the drive shaft 16 and such angular movement varies the timing of the commencement of fuel delivery to the associated engine. The aforesaid movement is effected by applying fluid under pressure to the cylinders 34 to act on the pistons 33 and conveniently the fluid under pressure is fuel which is derived from the passage 35. The control of fuel flow to the cylinders 34 is effected by a servo valve generally indicated at 56 in FIG. 4. The valve includes a valve member 57 which is slidably mounted within a bore 58 which traverses the passage 35. One end of the passage 58 is blind and it is connected to the passage 35 by means of a drilling formed in the valve member. The opposite end of the bore 58 is enlarged and it accommodates a spring 59 which biases the valve member towards the blind end of the bore. The spring 59 is interposed between a collar on the valve member 57 and an axially movable abutment 60 which as shown in FIG. 6, is engagable with a wedge member 61 mounted so as to be axially movable with the coupling member 27A. The valve member is so arranged that it is largely insensitive to centrifugal force.

The bore 58 adjacent the opposite end to the blind end thereof is of enlarged diameter to define an annular clearance which communicates with the cylinders 35, by way of ball valves 62, the valves 62 being so disposed as to permit fuel to flow to the cylinders 34 but to restrain flow of fuel in the opposite direction. The valve member 57 is shaped so that as the pressure of fuel which is applied to the valve member moves it against the action of the spring 59, fuel flows to the annular clearance and therefore to the cylinders 34. As a result of the fuel flow the pistons in the cylinders 34 move the annular coupling member 27A axially towards the left as seen in FIG. 1. This movement through the action of the wedge 61, moves the spring abutment 60 to increase the force exerted by the spring 59 on the valve member. A follow up servo action is therefore obtained and the position of the annular coupling member is determined by the pressure of fuel in the passage 35. This pressure is controlled so that it varies in accordance with the speed at which the apparatus is driven. As the outlet pressure of the low pressure pump decreases the valve member 57 will move under the action of its spring to cut off the flow of fuel to the cylinders 34 and under the action of springs 63 and cam reaction, fuel will leak from the cylinders, and the coupling member 27A will move relative to the drive shaft to retard the timing of fuel delivery. As the aforesaid springs effect relative movement of the coupling member and drive shaft the spring 59 relaxes and the valve member 57 moves to allow fuel flow to the cylinder so that an equilibrium position is established. The valves 62 act to minimise relative movement of the drive shaft and cam ring as a result of cam reaction.

The helical arrangement of one of the series of interengaging teeth, has the effect of moving the cam ring relative to the drive shaft to achieve with increasing speed, advancement of the timing of fuel delivery to the associated engine. Since the cam elements 55 which actuate the spill valve are also mounted on the cam ring, varying the timing of the commencement of fuel delivery does not vary the quantity of fuel which is supplied to the associated engine.

Although as described the pumping plungers 19 form the valves which are interposed between the pump working chamber 20 and the outlets 22, separate valves could be provided in the main body 10. The separate valves could be operated by a cam profile formed on the cam ring 25. In this case each one of the plungers 19 would be actuated at the same time to expel fuel from the pump working chamber.

In the example described one plunger is allowed to move outwardly to open the associated outlet passage 21 and is held in its outermost position whilst the remaining plungers are moved inwardly. This means that the maximum amount of fuel which can be delivered is limited to slightly less than the displacement of three plungers assuming that the spill valve is operated just before the crests of the cam lobes are reached. The one plunger can be made to deliver fuel by providing a cam profile in the recess 27. However if a cam profile is provided the lift of the cam profile and/or the depth of the recess must be such as to ensure that the plunger does not cover the associated passage 21 during its inward movement and the inward movement takes place at the same time as the inward movement of the remaining plungers.

The example described employs a mechanically actuated spill control valve 48. This can be replaced by an electromagnetically operable valve which is actuated in timed relationship with the drive shaft. Alternatively the spill valve 40 and the spill control valve 48 can be replaced by an electromagnetically operable spill valve the operation of which is determined by an electronic control system.

Figure 7:
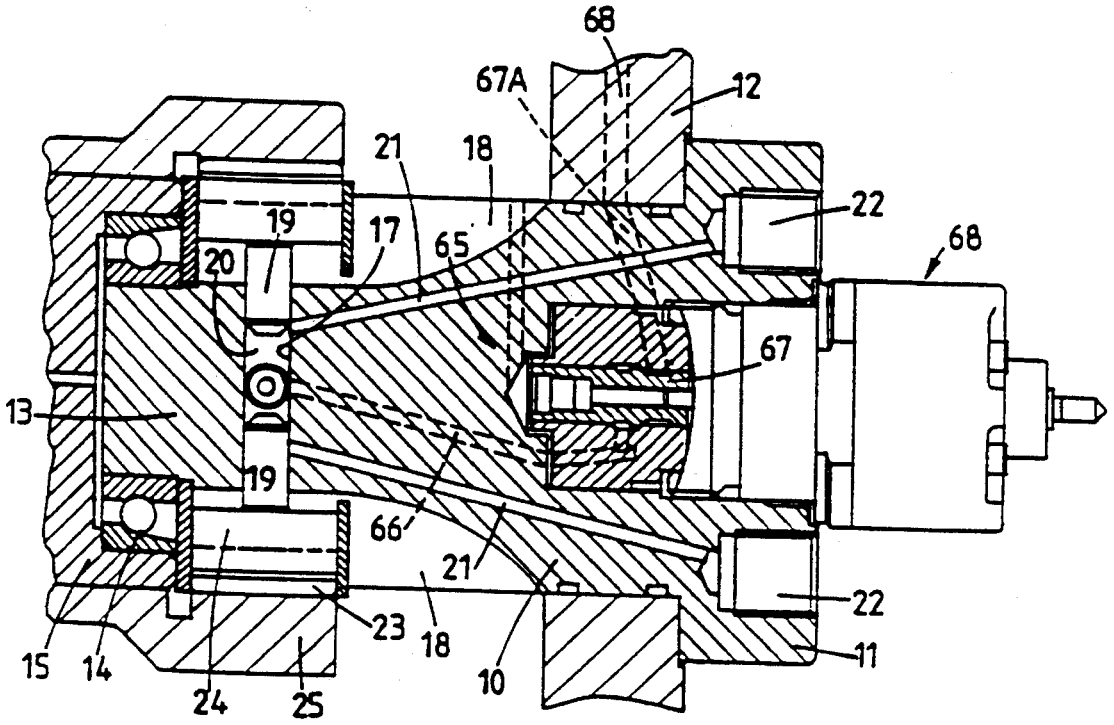

An example of an electromagnetically operable spill valve is seen in FIG. 7 and is generally indicated at 65. The spill valve is mounted within the body and controls the flow of fuel through a spill passage 66 which communicates with the pumping chamber 20. The spill valve includes a spill valve member 67 which is slidable in a passage under the action of an armature of an electromagnetic actuator 68 and defined in the passage is a seating and the valve member is shaped for cooperation with the seating. The valve member is urged into contact with the seating by energising the actuator 68 and in this position no fuel can flow through the spill passage 66. If whilst the plungers 19 are moving inwardly the actuator is de-energised, the valve member moves axially away from the seating and fuel can flow from the passage 66 to a passage 67A formed in the body 11 and connected through a passage 68 to the outlet of the low pressure fuel supply pump. When the valve member of the spill valve is moved to the open position the high pressure in the pumping chamber 20 is relieved and the further fuel which is displaced by the plungers flows through the passage 68 to the outlet of the low pressure fuel supply pump.

In this example the spill valve 65 is also used to control the admission of fuel to the pumping chamber 20 and for this purpose the actuator remains in the deenergised position for at least part of the period during which the plungers 19 can move outwardly. Fuel flows from the fuel supply pump through the passages 68 and 67A, through the spill valve and by way of the passage 66 to the pumping chamber. By controlling the quantity of fuel which is supplied to the pumping chamber the timing of fuel delivery by the plungers can be varied so that it is not absolutely necessary with this arrangement to have a mechanism for adjusting the angular relationship between the cam ring 25 and the drive shaft.

A disadvantage with the arrangement shown in FIG. 7 is that the provision of the passage 66 increases the volume of fuel at high pressure since in effect it forms an extension of the pumping chamber 20 and it also constitutes a restriction to spillage of fuel and also to the flow of fuel into the pumping chamber.

Figure 8:
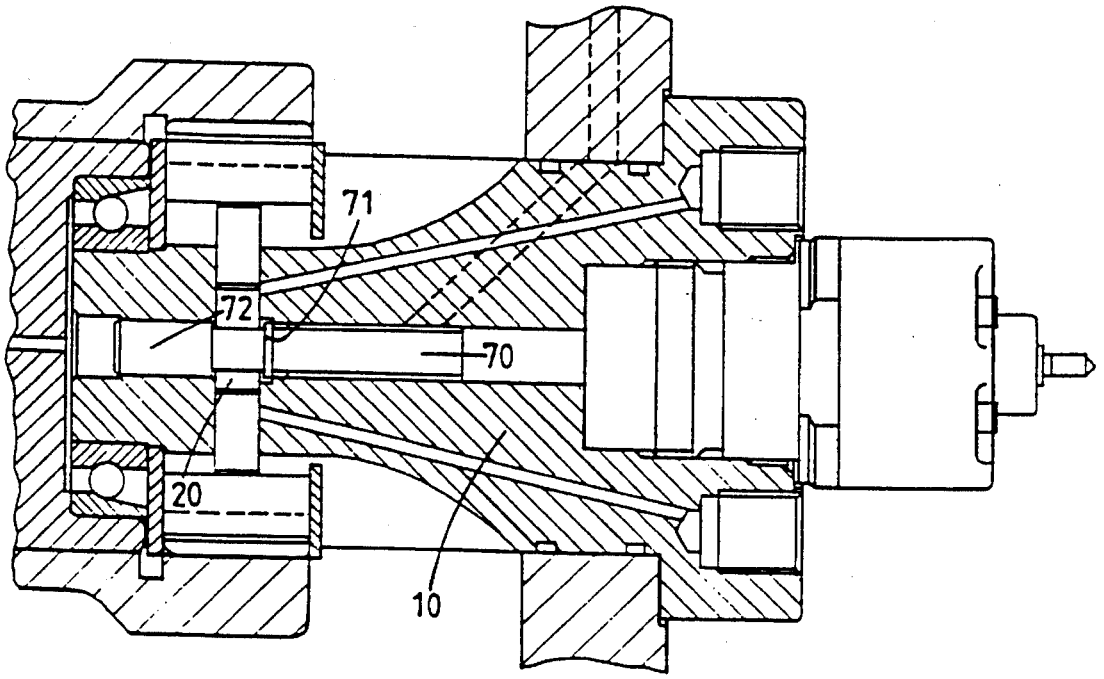

The restriction to the flow of fuel in both the filling and spilling directions, is reduced in the example shown in FIG. 8. In this arrangement the spill valve includes a valve member 70 having a head 71 engagable with a seating defined in a passage in the body through which the spill valve member extends. The seating is positioned adjacent the chamber. The spill valve has a reduced portion which traverses the pumping chamber and is coupled to a balancing piston 72. The function of the valve is the same as the valve shown in FIG. 1. The fact that the valve member traverses the pumping chamber 20 and the fact that the seating is adjacent the pumping chamber greatly reduces the volume of fuel at high pressure.

Figure 9:
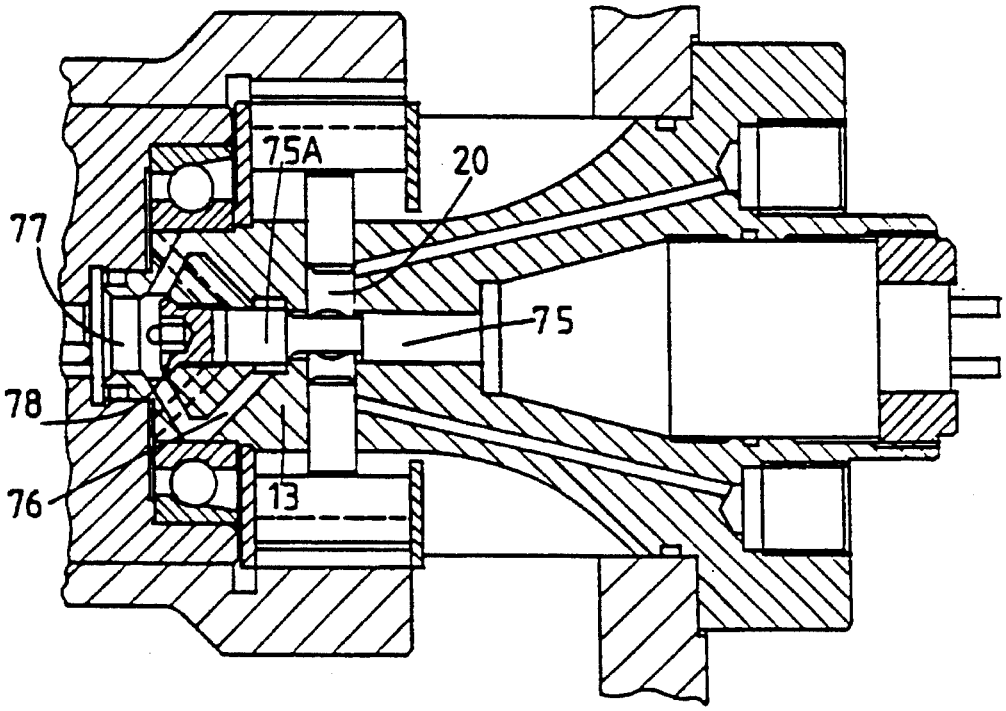

A further arrangement is shown in FIG. 9 and the spill valve member 75 again traverses the pumping chamber but it is the end portion 75A of the valve member remote from the actuator which is shaped to cooperate with a seating. The actuator is again energised to close the valve and when open the fuel escapes from the pumping chamber 20 by way of spill passages 76 formed in the spigot portion 13 of the body. The aforesaid passages also convey fuel to the pumping chamber 20 when the plungers are allowed to move outwardly. Preferably the spill passages 76 communicate with a chamber 77 which communicates with the outlet of the fuel supply pump. Moreover the end of the passage in the body is plugged by means of a plug 78 and the space intermediate the plug and the valve member is vented to a drain so that pressure pulses due to spillage of fuel will not act upon the valve member in the direction to close the valve member.

Figure 10:
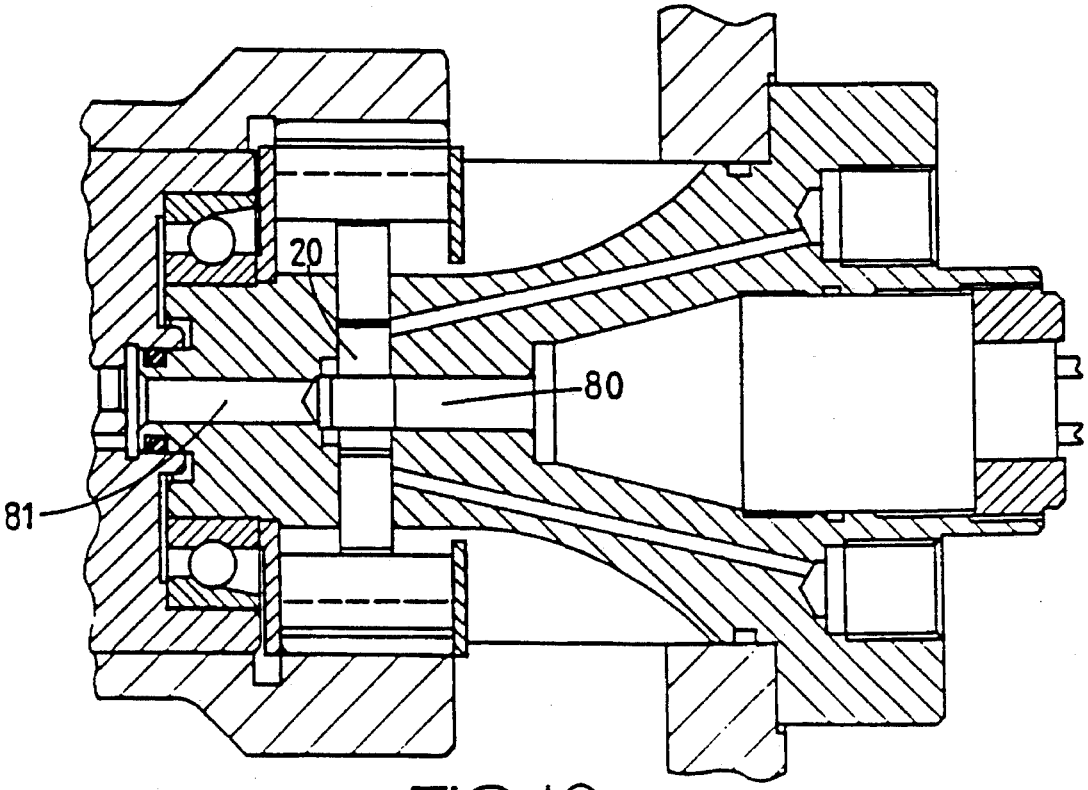

FIG. 10 shows a further modification in which the valve member 80 is pushed into engagement with a seating about a spill and filling passage 81 when the actuator is energised. Again a portion of the valve member traverses the pumping chamber 20 so that the volume of fuel which is subject to the high pressure developed when the pumping plungers are moved inwardly, is minimised.

In the examples shown in FIGS. 9 and 10 the spill passages 76 and 81 are connected to the outlet of the low pressure supply pump and are of appreciable size so that filling of the pumping chamber is not impaired.

Furthermore, although in the examples described in FIGS. 7–10 the spill valve is utilised to control the flow of fuel into the pumping chamber and hence is used to determine the timing of fuel delivery to the associated engine, a mechanism as described with reference to FIG. 1 may be employed to adjust the angular relationship between the rotary cam ring 25 and the drive shaft.

I claim:

1. A fuel pumping apparatus for supplying fuel to a multi cylinder internal combustion engine comprising a plurality of cam actuated pumping plungers (19) housed within respective bores (17) in a fixed body (10), the bores at their inner ends communicating with each other to form a pump working chamber (20), a cam member (25) having cam lobes (26) formed thereon for actuating the pumping plungers to displaced fuel from the pump working changer, a pump drive shaft (16) coupled to the cam member (25), a plurality of outlets (22) formed in the body and which are connected to the injection nozzles respectively of the associated engine, valve means (19, 21) responsive to the rotation of the pump drive shaft through which fuel displaced from the pump working chamber (20) is supplied to the outlets (22) in turn during successive delivery periods said valve means (19) being housed in said body (10) and being interposed between the pump working chamber (20) and the outlets respectively, means (36) for supplying fuel to the pump working chamber (20) between said delivery periods, spill valve (40) operable to allow fuel to escape from said pump working chamber during the inward movement of the pumping plungers (19), a control valve (48) for controlling the operation of the spill valve and cam elements (55) movable relative to the control valve (48) for actuating the control valve.

2. An apparatus according to claim 1, characterized in that said valve means is defined by the pumping plungers respectively, and the cam member (25) is arranged so that one of the plungers is moved to a position to allow fuel flow from the pump working chamber (20) to one of the outlets (22), the plungers being moved to said position in turn so that the outlets (22) receive fuel.

3. An apparatus according to claim 2, characterised in that said pumping plungers (19), when in said position, uncover the pump working chamber ports formed in the respective bores (17), the ports through respective outlet passages (21), communicating with said outlets (22).

4. An apparatus according to claim 3, characterised in that the cam member (25) at one angular position is provided with a recess (27) whereby the pumping plungers can move outwardly to said position in turn.

5. An apparatus according to claim 1, characterised in that said cam elements (55) are mounted on said cam member (25) and said control valve (48) is mounted in the body (10).

6. An apparatus according to claim 5, characterised by a beam (51) which is mounted on an adjustable pivot (52), the beam defining a projection (54A) for engagement by the cam elements (55) and engaging an operating member of the control valve (48), the pivot being adjustable to vary the relative position of the body and cam member (25) at which the control valve (48) causes operation of the spill valve (40).

7. An apparatus according to claim 6, characterised in that said cam elements (55) are adjustably mounted on said cam member.

8. An apparatus according to claim 7, characterised in that each cam element (55) is of cylindrical form and its external surface is eccentric relative to an aperture therethrough which receives a securing screw.

9. An apparatus according to claim 4, characterised by a cam profile in said recess (27) said cam profile acting to impart limited inward movement to the plunger at said position at the same time as the inward movement of the remaining plungers.

10. An apparatus according to claim 1, characterized in that said cam elements (55) are mounted on said cam member and said control valve (48) is mounted in the body (10).

* * * * *